US005097821A

United States Patent [19]

Eakin

[11] Patent Number: 5,097,821

[45] Date of Patent: Mar. 24, 1992

[54] SOMATIC MUSICAL EXPOSURE SYSTEM

[76] Inventor: Byron C. Eakin, 9258 Lazy La., Tampa, Fla. 33614

[21] Appl. No.: 238,424

[22] Filed: Aug. 31, 1988

Related U.S. Application Data

[63] Continuation-in-part of Ser. No. 112, Jan. 2, 1987, abandoned, which is a continuation of Ser. No. 807,711, Dec. 10, 1985, abandoned.

[51] Int. Cl.[5] ..... A61H 1/00

[52] U.S. Cl. ..... 128/33; 128/32

[58] Field of Search ..... 128/24 R, 33, 25 A, 128/24 A, 24 A A, 64, 32; 5/451, 462, 507, 568

[56] References Cited

U.S. PATENT DOCUMENTS

| | | | |
|---|---|---|---|
| 3,050,051 | 8/1962 | Moxley | 128/33 |
| 3,071,132 | 1/1963 | Lucht | 128/33 |
| 4,124,249 | 11/1978 | Abbeloos | 5/462 X |
| 4,181,991 | 1/1980 | Morgan et al. | 5/400 |
| 4,354,067 | 10/1982 | Yamada et al. | 128/33 X |
| 4,507,816 | 4/1985 | Smith, Jr. | 5/451 |

*Primary Examiner*—Edgar S. Burr
*Assistant Examiner*—Moshe I. Cohen
*Attorney, Agent, or Firm*—Dominik, Stein, Saccocio, Reese, Colitz & Van Der Wall

[57] ABSTRACT

Somatic musical exposure system for a person, preferably in recumbent position on substantially rigid supporting means. Music emanates from an air chamber in a sound housing spaced apart from the person-supporting means. A relatively fixed frame carries the person-supporting means and also the sound housing, at least the former and optionally the latter being resiliently mounted relative to the frame and thereby partly decoupled therefrom. Such resilient mounting is preferably provided by elastomeric means intervening between the frame and the means resiliently supported thereby and extending both lengthwise and widthwise. Striplike resilient mounting means preferably extends both along peripheral edges of the person-supporting means and transversely thereof between its ends.

1 Claim, 2 Drawing Sheets

SOMATIC MUSICAL EXPOSURE SYSTEM

This application is a continuation-in-part of my copending patent application, Ser. No. 000,112 filed 2 Jan. 1987, now abandoned, which is a continuation of Ser. No. 06/807,171 filed Dec. 10, 1985, now abandoned.

FIELD OF THE INVENTION

This invention relates to means and methods whereby a recumbent listener exposed to music experiences not only audible sensations but also tactile sensations therefrom.

BACKGROUND OF THE INVENTION

Since time immemorial, music has been recognized as being somehow soothing to the spirit as well as pleasing to the ear. Many people believe they work or study better within a musical environment, and some types of music are considered relaxing. Many recent developments in sound generation and reproduction equipment have accentuated and facilitated music appreciation. Music encourages such bodily activity as dancing and is now a common accompaniment to individual or group exercise programs.

Bodily well-being is enhanced by voluntary exercise, but if such exercise is impracticable or is not well distributed throughout the body or is carried to excess a form of passive exercise or "massage" often proves beneficial. Similarities between repetitive exercise and massaging movements, on the one hand, and various mechanical actions, on the other hand, have led to numerous mechanized beds, chairs, and tables. Music also has its repetitive aspect, so it is not surprising that music is common in active and passive exercise activity.

Indeed, efforts have been made to apply musical or other sonic vibrations more broadly to the body than merely to the ears. Thus, Nohmura in U.S. Pat. No. 3,880,152 and 4,055,170 and Martimaas in U.S. Pat. No. 4,023,566 disclose sitting or reclining means with loudspeakers directed toward the back of the person thereon, but their systems are too loosely coupled to the supported person to be conducive to the best effects.

Other inventors have employed liquids for transmitting various vibrations to the body, such systems are too tightly coupled to be conducive to relaxation. The same is true of systems with body support affixed rigidly to the frame of the apparatus, as in Leitner U.S. Ser. No. 845,875 filed on 27 Oct. 1973 referred to in German publication 2,846,859 on 10 May 1977 claiming priority of that U.S. patent application.

My somatic musical exposure system rexedies the failings of the prior art and provides new levels of entertainment and passive exercise with many benefits for those exposed thereto.

SUMMARY OF THE INVENTION

In general, the objects of the present invention are to be attained via housing means defining a chamber of air open upward, means providing such housing means with music, and means supporting a recumbent person above the chamber and thereby somatically exposed to music emanating therefrom.

More particularly, such apparatus features a supporting frame, a sound housing supported thereby, an air chamber open upwardly therefrom, and loudspeakers opening thereinto, also a substantially rigid and laminar person-support thereabove, foraminous in part and supported resiliently by the frame.

A principal object of the present invention is to enhance the overall exposure of a listener to musical vibrations.

Another object of this invention is to transmit musical vibrations to the body as well as to the ears of a listener.

A further object of the invention is to accomplish the foregoing objects in a somatic musical exposure system.

Other objects of this invention, together with means and methods for attaining the various objects, will be apparent in the following description and the accompanying drawings of a preferred embodiment of the invention and variants thereof, which are presented by way of example rather than limitation.

DETAILED DESCRIPTION

Figure 1:
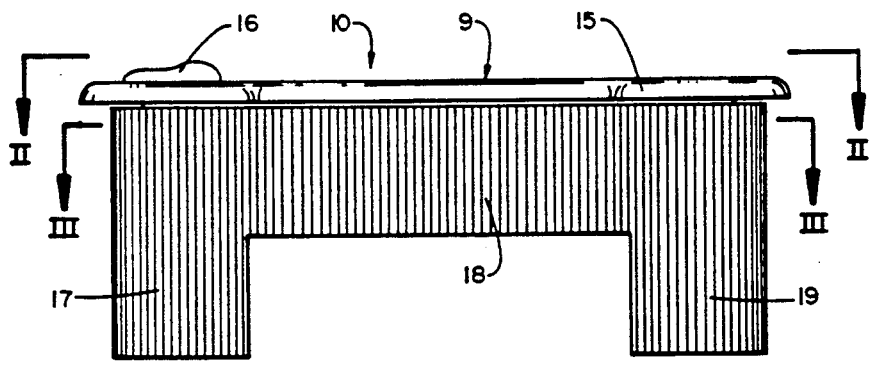
FIG. 1 is a front elevation of a first embodiment of the present invention in unitary apparatus form.

FIGS. 1 through 4 show first apparatus embodiment 10 of the present invention from various vantage points. FIG. 1 is a side view, featuring relatively thin top portion 9, which includes border member 15 with head rest 16 at its left end. Underneath is an extensive vertically slatted base with end pedestals 17 and 19 at the left and right, respectively, and raised sidewall 18. The slats of the base are spaced apart by intervening slits (indicated simply by vertical lines), being useful for absorption of undesired or reverberating sound.

Figure 2:
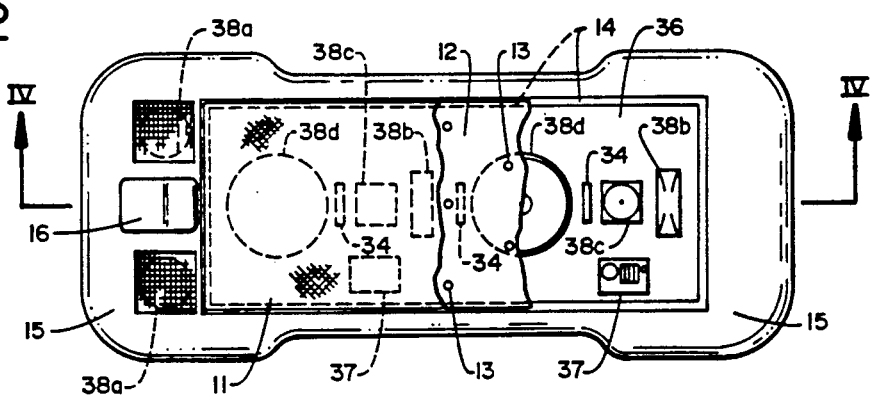
FIG. 2 is a plan view thereof, taken at II—II in FIG. 1 and partly cut away to reveal the interior.

FIG. 2 shows apparatus 10 in plan, as indicated at II—II on FIG. 1, but in part cut away to reveal successive layers and its interior components otherwise shown in broken lines. Generally rectangular, partly curvilinear border member 15, arcuate at the corners and recessed laterally along its sides, surrounds rectangular body-supporting laminar member 12, which is covered by mat 11. Resilient supporting strip 14 extends along and under a striplike rectangular edge of the laminar body-supporting member, and similar short strips 34 underlie and support it intermediately. Actually only the top portion (stippled) of such strips is resilient. Interior components, indicated in broken lines as being underneath the top, and others in solid lines where the top is broken away, include loudspeakers 38*a, b, c, d,* along with crossover networks 37.

Figure 3:
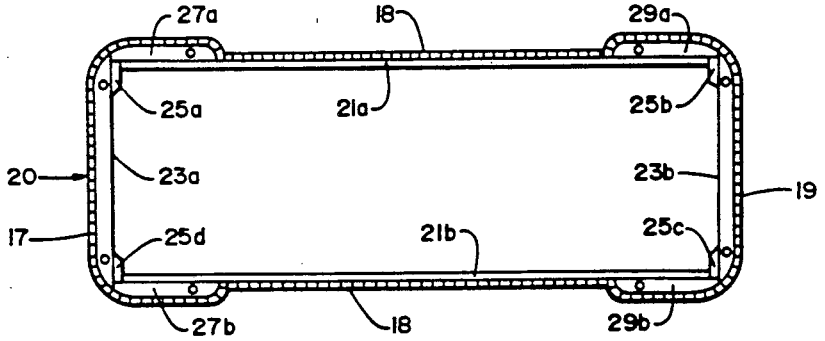
FIG. 3 is a plan of the supporting frame and base thereof, taken at III—III in FIG. 1, less its supported components.

FIG. 3 shows frame 20 in plan, as taken at III—III in FIG. 1, underneath top portion 9 but omitting interior components supported by the frame. Spaced parallel pair of sidewall pieces 21*a*, 21*b* terminate at inside faces of corner pieces 25*a*, 25*d* at the left and corner pieces 25*b*, 25*c* at the right along inside faces of endwall pieces 23*a* at the left and 23*b* at the right, and also along the inside faces of two pairs of flanking pieces 27*a*, 27*b* at the left and 29*a*, 29*b* at the right aligned with the intervening recesses along the sides. The resilient supports for the top portion overlie the two ends of the endwall and one end part of each of the flanking pieces to interconnect it non-rigidly (partially decoupled) to the frame.

Figure 4:
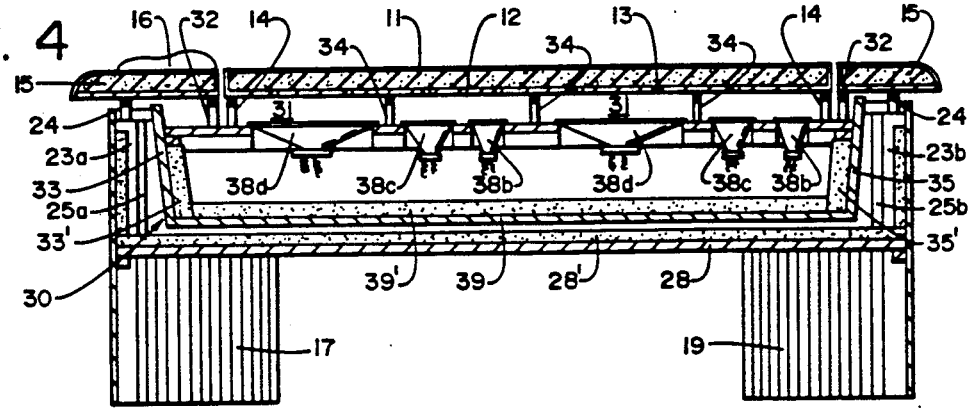
FIG. 4 is a medial side elevational section of the same embodiment, taken at IV—IV in FIG. 2.

FIG. 4 shows first apparatus embodiment 10 in sectional elevation taken at IV—IV in FIG. 2. Interior components on the center line appear unsectioned, and such components not present along the longitudinal vertical plane do not appear, but exterior parts of base pedestals 17 and 19 beyond the plane of the view do appear to round out the view.

FIG. 4 features formerly unseen sound housing 30, which resembles a bathtub, being open at the top and closed at its bottom 39, and at both its vertical sidewalls (not visible here) and its inclined ends 33, 35. The housing is lined or double-walled with a sound-absorbing layer designated by primed, otherwise identical reference numerals. The sound housing is supported indirectly by the frame, via hangers 32 extending down from border member 15—whose resilient support on the frame was noted in connection with FIG. 3—to connect with partition panel 36 of the sound housing. The partition extends across the sound housing at a level above the bottom and below the top edges to support various upwardly oriented loudspeakers: 38*a* (full range, say several dozen Hz to above 15 kHz), 38*b* (horn tweeter, from 7 or 8 to about 2.0 kHz), 38*c* (midrange, from about 1 to 7 or 8 kHz), and 38*d* (woofer, from about 20 Hz to 1 kHz). Spaced thereabove by intervening air chamber 31 is body-support 12 overlain by mat 11. Openings 13 at intervals through the body-support render it in part foraminous, and resilient peripheral strip 14 and short intermediate strips 34 carry the laminar support (and mat) on the partition panel.

Operation of this first apparatus embodiment is readily understood. A person lies on the resilient mat overlying the rigid body-supporting lamina, with his or her head on the head rest. The person usually lies supine but optionally may be prone or even lying on one side. Via a control panel (not shown) such person or an operator switches on the amplifiers tuned to a musical program on radio, audiotape, etc. Musical vibrations from the loudspeakers reach the ears of the person through the surrounding air much as from any source and reach the person's body through the intervening air chamber, in part through vibration of the supporting rigid lamina and the mat thereon (if present) and in part more directly through the openings in the lamina with or without such intervening mat.

Figure 5:
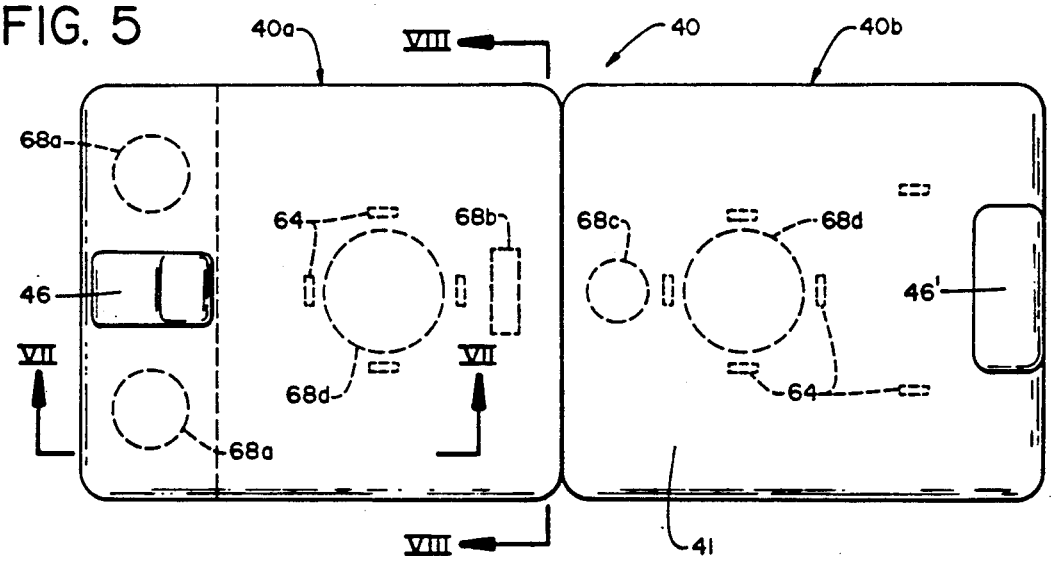
FIG. 5 is a a plan view of an alternative embodiment of the invention in multiple modular, rather than unitary, form.
Figure 6:
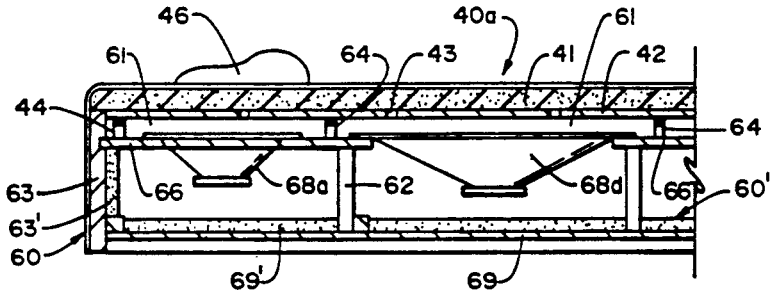
FIG. 6 is a fragmentary side sectional elevation, taken just under the outer sidewall, at VI—VI in FIG. 5.
Figure 7:
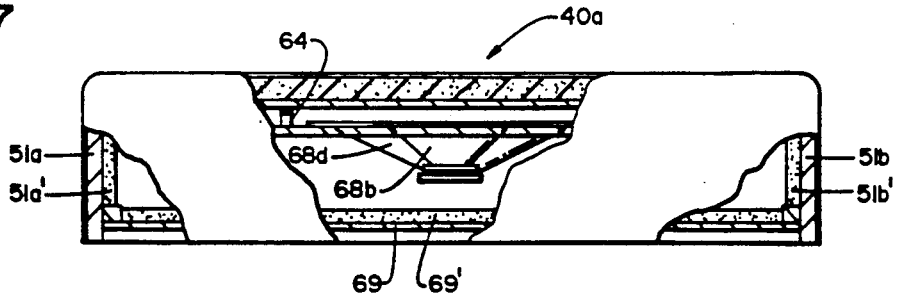
FIG. 7 is a fragmentary transverse sectional elevation, taken just offset from halfway, at VII—VII in FIG. 5.

FIGS. 5 to 7 illustrate second apparatus embodiment 40 of this invention in modular form. In these views, components corresponding more or less closely to those of the previous embodiment are designated by reference numerals greater by 30. Accordingly, it is unnecessary here to mention every numbered component or part. This embodiment may be equipped with a base or merely legs, but—as it also may be placed directly on the floor or on a bed, table, etc.—no base or legs are shown.

The vibrations of the supporting rigid lamina, in association with the resilient strips therearound, renders the air chamber 31 of a variable volume when music is played from the loud speaker to vibrate the supporting lamina. In contrast to this, the air space beneath the speakers, in association with the non-resilient supports therearound, renders such lower air space of a fixed volume.

FIG. 5 shows, in plan, module 40*a* (with head rest 46) at the left, and module 40*b* at the right (with foot rest 46′). Loudspeakers 68*a* and 68*d* underneath the top are indicated in broken lines, as are peripheral (see FIG. 6) and intermediate resilient decoupling supports 44 and 64 therefor. The pair of individual modules may be separate—and be placed together as shown—or may be held together with hinges or the like to enable them to be folded for better portability.

FIG. 6 shows left module 40*a* fragmentarily in section, as taken at VI—VI in FIG. 5, just within the exterior near wall. Here sound housing 60 is rather compact, with partition panel 66 supported by uprights 62 on bottom 69 lined with layer 69′. Air chamber 61 overlies the partition panel and underlies the top portion made up of rigid lamina 42 and overlying resilient mat 41. Left wall 63 of the chamber is notched to receive and support the end of the partition panel and is contiguous with the mat but not with the laminar body support, which rests on resilient peripheral and intermediate supports 44 and 64, for an appropriate degree of decoupling to allow limited movement.

FIG. 7 shows left module 40*a* sectioned just within the end wall not shown in the preceding view. Visible here are many of the components shown in the preceding view, as well as front and rear walls 51*a* and 51*b* of the sound housing—along with their linings 51*a*′ and 51*b*′. In this embodiment, the external walls (unprimed numerals) extend to a floor, table, bed, etc. (not shown) and function as the frame; the lining layer (primed numerals) functions as the sound housing proper.

Operation of this second apparatus embodiment does not differ substantially from that of the first embodiment. Electrical connections (not shown) of the respective modules may be entirely separate, or one may plug into another one. One may be used alone, as by a child or other short person. Added modules may be interposed or be placed side by side.

Figure 8:
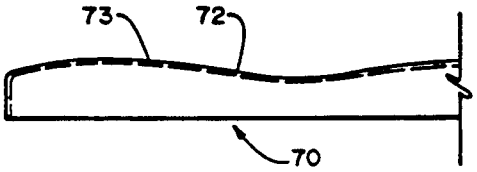
FIG. 8 is a side sectional elevation of an alternative contoured body-supporting member useful in either embodiment.

FIG. 8 shows third embodiment 70 of the body support of this invention having lamina 72 contoured to accommodate human bodily configuration and being hollowed underneath. Such body-supporting member may be used without an overlying mat and provide via openings (foramina) 73 therein even more direct passage for music vibrations than with a covering mat.

The apparatus of this invention may be constructed from readily available materials. The resilient strips to decouple the body-supporting means partially from the frame may be made of natural or synthetic rubber or similarly useful elastomer, such as polyurethane, in conventional thickness and stiffness, preferably in the form of a closed-cell foam filled with air.

The body support, the frame, housing, and base (if any) may be made of wood and/or of any of many polymeric plastic compositions. Lining layers may be of cork or of wood or plastic with openings recessed therein or of plastic foam, for example. Loudspeakers are available from many electrical supply houses. If desired, the loudspeakers or equivalent sound-emanating equipment may be located elsewhere and the sound therefrom be piped into the sound housing and via the air chamber toward a person on the body support.

The benefits of the inventive apparatus and method have been mentioned but should be experienced rather than merely described. Many persons find the experience to be a blend of entertainment, relaxation, and invigoration. Others would emphazise resulting effectiveness at work, study, or play.

Just as many business, commercial, and industrial firms and organizations are providing exercise facilities for their personnel, thereby enabling them to work more effectively, so can the present invention benefit them. Thus, manufacturing of the apparatus of this invention will aid the economy both directly from its manufacture and sale and indirectly through increasing the output of persons using such equipment.

Various embodiments have been presented here. They may be modified, as by adding, combining, or subdividing parts or steps, while retaining advantages and benefits of the present invention—which itself is defined in the following claims.

The claimed invention:

1. An acoustical somatic massage apparatus for exposing users to sound vibrations from music for relaxing muscles and stimulating imagery, comprising:

a lower chamber formed of a planar lower horizontal member, a planar intermediate horizontal member thereabove, and vertical members therebetween to define an essentially closed chamber, the members of the lower chamber being rigid to define a fixed volume therebetween;

an upper chamber formed of the planar intermediate member, a planar upper horizontal member thereabove, and vertical members therebetween to define an essentially closed chamber, the horizontal members of the upper chamber being rigid and the vertical members of the upper chamber being resilient to define a variable volume therebetween;

loudspeaker means mounted in aperture means within the intermediate member with, the loudspeaker means facing upwardly for creating sound vibrations in the upper chamber to vary the volume of the upper chamber and with its magnet and coil means depending into the lower chamber; and resilient padding means disposed over the top surface of the planar upper horizontal member.

* * * * *